United States Patent [19]

Hayashi

[11] Patent Number: 4,459,882

[45] Date of Patent: Jul. 17, 1984

[54] GEAR WRENCH WITH TORQUE METER

[76] Inventor: Mikio Hayashi, 26-5, Toyotama-minami 2-chome, Nerima-ku, Tokyo, Japan

[21] Appl. No.: 379,831

[22] Filed: May 19, 1982

[51] Int. Cl.[3] ..... B25B 23/142

[52] U.S. Cl. ..... 81/477

[58] Field of Search ..... 81/477, 57.31

[56] References Cited

U.S. PATENT DOCUMENTS 3,744,350 7/1973 Raff ..... 81/477

4,155,278 5/1979 Estok ..... 81/57.31

4,249,435 2/1981 Villeneuve et al. ..... 81/477

*Primary Examiner*—James L. Jones, Jr.

*Attorney, Agent, or Firm*—Ladas & Parry

[57] ABSTRACT

An input shaft and a main shaft which transmits torque from the input shaft to torque amplifying means are separately provided and a horseshoe-shaped elastic member is deformed according to the applied torque, thereby the overloaded transmission of torque to the main axis is prevented and a rough amount of transmitted torque is indicated at a surface of the wrench.

6 Claims, 5 Drawing Figures

GEAR WRENCH WITH TORQUE METER

BACKGROUND OF THE INVENTION

A. Field of the Invention

The present invention relates to a gear wrench with a torque meter, or more precisely, such gear wrench wherein an input shaft and a main shaft which transmitts torque from the input axis to a torque amplifying mechanism are separately provided and a horseshoe-shaped elastic member is positioned between these shafts so that the elastic member is deformed in accordance with the applied torque, whereby overloaded transmission of torque to the main axis is prevented and an estimate of transmitted torque is indicated at a surface of the wrench.

B. Description of Prior Art

In fastening a nut to a bolt of a wheel of a motor car, it is almost impossible to completely fasten the nut to the bolt with a wrench which simply transmitts human power. To cope with this, a gear wrench which amplifies a generated torque has been developed in recent years. A torque wrench is especially useful for unfastening a rusty nut from a bolt, because plenty of torque can be exerted by human power.

However, by such gear wrench, the nut is excessively fastened by the torque generated by human power and, in extreme cases, the bolt is damaged. Such an accident is due to the fact that a worker cannot precisely perceive the torque generated by the gear wrench and an accident tends to occur frequently, the better the amplifying function of the gear wrench being used.

SUMMARY OF THE INVENTION

Accordingly, it is the primary object of the invention to obtain an improved gear wrench with a torque meter.

It is another object of the invention to obtain a gear wrench with a torque meter by which the overloaded transmission of torque to a main shaft is prevented.

It is further object of the invention to obtain a gear wrench with a torque meter by which a rough estimate of the transmitted torque can easily be seen by a worker.

To achieve these objects, a main shaft for transmitting torque from an input shaft to a torque amplifying means is separately provided from the input shaft which is rotated by human power, a horseshoe-shaped elastic member being provided between these shafts, one end of the elastic member being connected to the input shaft and other end to the main shaft, so that the elastic member is deformed when torque is transmitted to the main shaft and, in case the amount of torque becomes excessive, the horseshoe-shaped elastic member winds itself around the periphery of the input shaft to stop further deformation and to act as a torque limiting means, the amount of distorsion of the horseshoe-shaped elastic member which is proportional to the applied torque being shown as a rotational discrepancy of collar members of both the input and main shafts, the collar members having scales around them, so that an estimate of generated torque can easily be seen. The other and further objects of the invention will be clarified by the following detailed description with drawings. But, the description and drawings show only an example of the invention and the invention shall not be limited to this embodiment.

DESCRIPTION OF THE PREFERRED EMBODIMENT

An embodiment of the invention will be described hereinunder with reference to acttached drawings.

Figure 1:
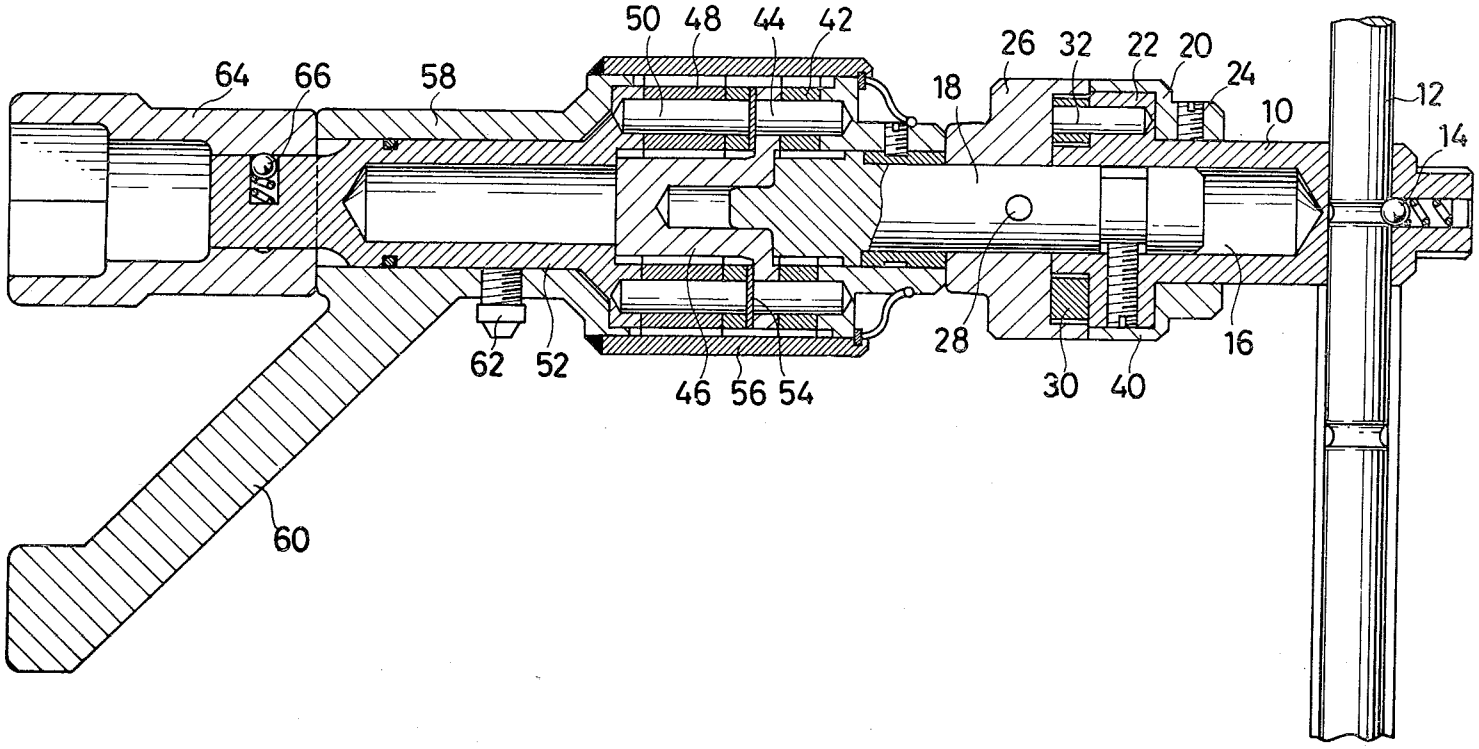
FIG. 1 is a cross-sectional view showing an embodiment of a gear wrench with a torque meter according to the present invention.
Figure 3:
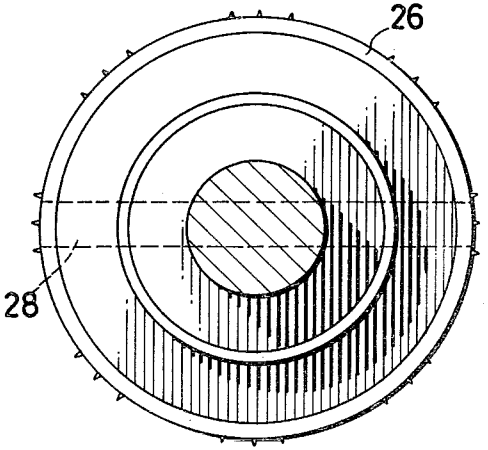
FIG. 3 is a front view along an arrow III of FIG. 2.
Figure 2:
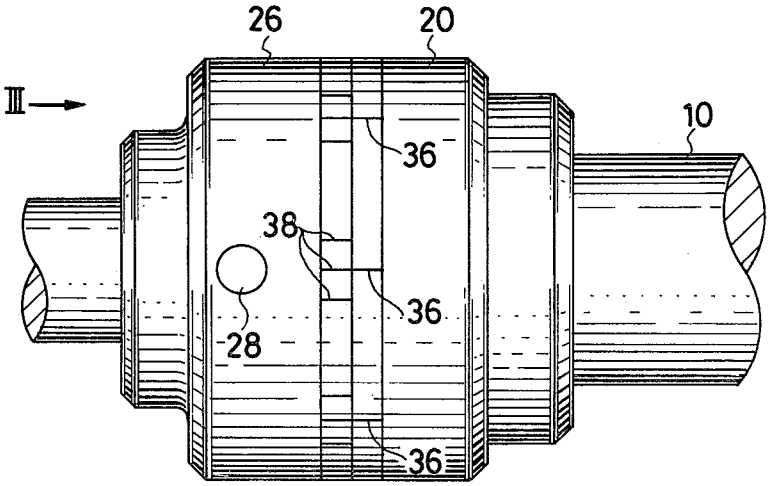
FIG. 2 is a side elevation of collar members at the periphery of both input and main shafts.
Figure 5:
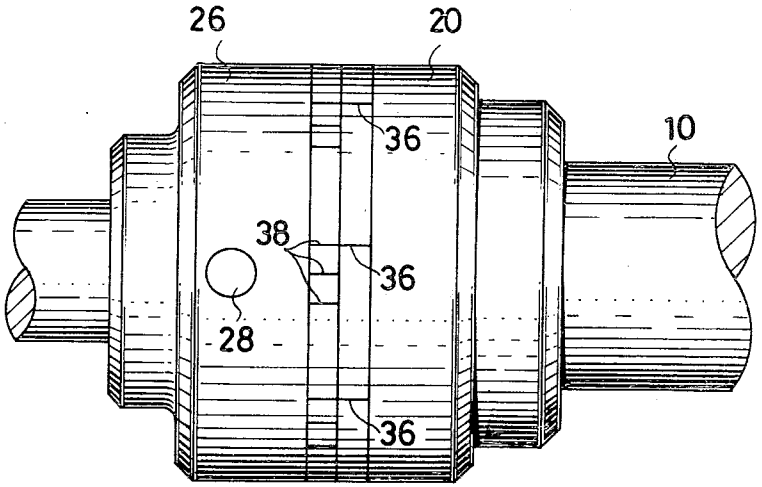
FIG. 5 is a side elevation of the collar members of FIG. 2 to which torque is applied.
Figure 4:
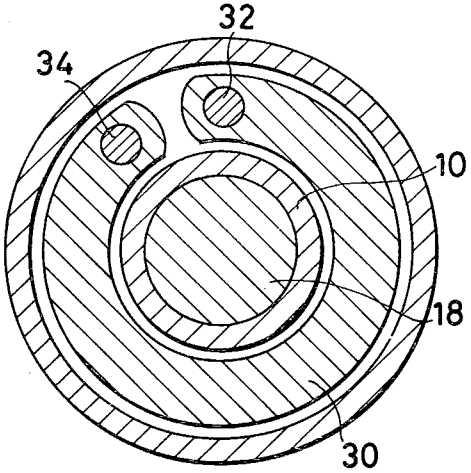
FIG. 4 is a cross-sectional view of a horseshoe-shaped elastic member.

In FIG. 1, numeral 10 indicates an input shaft which is rotated by a human power and a shaft 12 is inserted in one end of it at right angle. When the shaft 12 is rotated by a worker, the input shaft 10 is rotated accordingly. Numeral 14 indicates a ball stopper forced by a spring and the shaft 12 can be secured to the input shaft 10. At the other end of the input shaft 10, a hole 16 is provided and one end of a main shaft 18 which is connected to torque amplifying means is inserted in the hole 16. Numeral 20 indicates a collar member around the input shaft 10. The collar member 20 covers the periphery of a flange portion of input shaft 10 and is rotated simultaneously with the input shaft 10 due to a stopper bolt 24. Furthermore, scales are attached to the collar member 20. Numeral 26 indicates a collar member of main shaft 18. The collar member 26 is fixed to the main shaft 18 by a pin 28 and is opposed to the collar member 20 of input shaft 10 and scales are attached which corresponds to the scale of collar member 20. There is a recess or concave portion in collar member 26 at its side adjacent shaft 10 and a horseshoe-shaped elastic member 30 is positioned between the concave portion and the flange 22 of input axis 10. One end of the horseshoe-shaped elastic member 30 is connected to the flange portion 22 of input shaft 10 by a pin 32 and the other end to the collar member 26 of main shaft 18 by a pin 34. Only by way of the elastic member 30, is the torque generated by the input axis 10 transmitted and the elastic member 30 is deformed in accordance with the transmitted torque. In other words, the torque is applied to one end of the horseshoe-shaped elastic member 30 by way of the pin 32 from the flange portion 22 of input shaft 10. The inner diameter of elastic member 30 is reduced or enlarged due to the torque and the torque is transmitted to the collar member 26 which is fixed to the main shaft 18 by way of another pin 34. It should be noted that, as the form of the elastic member 30 is horseshoe-shaped, and it can uniformly be distorted while centered around both input and main shafts 10, 18, smooth deformation of the member 30 is possible in over a wide range of torque. If the torque becomes excessive, the inner portion of the horseshoe-shaped elastic member 30 winds itself around the circumference of the input shaft 10 so as to restrict further deformation and to act as a torque limitter. The fact that the horseshoe-shaped elastic member 30 winds itself around the circumference of the input shaft 10 can be sensed by a hand of a worker who rotates the shaft 12. As the elastic member 30 is deformed when the torque is transmitted to the main shaft 18 from the input shaft 10, the collar members 20, 26 which are respectively fixed to the input and main shafts 10, 18 rotate with respect to one another. The extent of such relative rotation is proportional to the amount of distorsion of the elastic member 30, i.e. the transmitted torque. As shown in FIGS. 2 and 3, a standard scale 36 having a single line is attached to the circumference of the collar member 20 of input shaft 10 and three lines of limit scales 38 are indicated at the circumference of the collar member 26 of the main shaft 26. The center line of the limit scale 38 agrees with the standard scale 36 when no load is applied. But, when a worker rotates the shaft 12, these scales 36, 38 are displaced with respect to each other in proportion to the deformation of the elastic member 30. At the maximum of the amount of torque, a limit line of scale 38 lines up with the standard scale 36 as shown in FIG. 5. In this way, summary of the amount of torque is shown on the periphery of collar members 20 and 26, whereby the worker can acknowledge at once the safety limit of torque and such an accident as a nut being broken can be prevented. Numeral 40 indicates a stopper bolt to prevent escape of the main shaft 18 from the hole 16 of input shaft 10.

The torque amplifying means is used to increase by a factor of twelve, the torque generated by the worker who rotates the shaft 12, by use of a gear mechanism. Since such a gear mechanism is known and the mechanism is not the gist of the invention, only a brief description will be made to such mechanism. The periphery of main shaft 18 is engaged with a planetary gear 42 which is fixed to an intermediate shaft 46 by a pin 44. The intermediate shaft 46 with special form is in contact with the tip end of main shaft 18, but the shaft 46 can only be rotated by way of the planetary gear 42. The intermediate axis 46 meshes with another planetary gear 48 whose rotation is transmitted to a hangershaft 52 by a pin 50. Numeral 54 indicates a separator for keeping apart the pins 44, 50. Numeral 56 indicates an ordinary casing for housing the gear mechanism. The hangershaft 52 is rotatably provided within a cylindrical member 58 to which a foot portion 60 and a grease nipple 62 are attached. At the forward portion of the hangershaft 52, a socket with hexagonal hole is fixed by a ball stopper 66. The socket 64 fits with a nut (not shown) and the nut is rotated on account of the transmitted torque and the conter-torque of the foot portion 60.

What is claimed is:

1. A gear wrench comprising:

(a) an input shaft for receiving torque;

(b) a torque amplifying means;

(c) a main shaft for transmitting torque acting on said main shaft to said torque amplifying means, said main shaft having a recess in an end part of said main shaft;

(d) an end part of said input shaft extending into said recess to define, between an outer surface of said input shaft and a wall of said recess, an annular space;

(e) a horseshoe-shaped elastic member for transmitting torque between said input shaft and said main shaft, said member being disposed in said annular space, said member being attached to said input shaft at substantially a first end of said member, said member being attached to said main shaft at substantially a second end of said member, said member being deformable, so that relative rotation between said input shaft and said main shaft occurs when torque is applied between said input shaft and said main shaft, said member being sized and shaped and attached to said input shaft and said main shaft so that under conditions of sufficiently low torque between said input shaft and said main shaft said member is positioned so as to be suspended from contact with said outer surface of said input shaft, said member being deformed upon application of sufficiently high torque between said input shaft and said main shaft so that said member comes into contact with said outer surface of said input shaft; and (f) a socket operatively connected to said torque amplifying means to transmit torque to a part to be rotated by said wrench.

2. The gear wrench of claim 1 further comprising:

(a) a first collar which rotates with said input shaft, said first collar having a first scale;

(b) a second collar which rotates with said input shaft, said second collar having a second scale, whereby an estimate of the torque between said input shaft and said main shaft is shown by the relative rotational displacement of said first and second collars.

3. The gear wrench of claim 1 wherein the member is also sized and shaped and attached to said input shaft and said main shaft so that it is suspended from contact with said wall of said recess in said end part of said main shaft.

4. The gear wrench of claim 1 wherein said torque amplifying means comprises a gear mechanism having a planetary gear.

5. The gear wrench of claim 1 in which the elastic member, at a sufficiently high torque level, is wound tightly around said end of said input shaft so as to limit further deformation of said elastic member.

6. The gear wrench of claim 1 in which said elastic member first is deformed and then comes into contact with said outer surface of said input shaft as the relative torque in one given direction between said input shaft and said main shaft is increased.

* * * * *